US010435239B2

(12) United States Patent
Sundholm

(10) Patent No.: US 10,435,239 B2
(45) Date of Patent: Oct. 8, 2019

(54) APPARATUS FOR HANDLING MATERIAL, AND WASTE CONTAINER/SEPARATING DEVICE

(71) Applicant: MARICAP OY, Vantaa (FI)

(72) Inventor: Göran Sundholm, Tuusula (FI)

(73) Assignee: MARICAP OY, Vantaa (FI)

( * ) Notice: Subject to any disclaimer, the term of this patent is extended or adjusted under 35 U.S.C. 154(b) by 403 days.

(21) Appl. No.: 15/104,848

(22) PCT Filed: Dec. 2, 2014

(86) PCT No.: PCT/FI2014/050940
§ 371 (c)(1),
(2) Date: Jun. 15, 2016

(87) PCT Pub. No.: WO2015/092122
PCT Pub. Date: Jun. 25, 2015

(65) Prior Publication Data

US 2016/0311614 A1 Oct. 27, 2016

(30) Foreign Application Priority Data

Dec. 20, 2013 (FI) ..... 20136310

(51) Int. Cl.
*B65F 1/14* (2006.01)
*B30B 9/30* (2006.01)
(Continued)

(52) U.S. Cl.
CPC ..... *B65F 1/1405* (2013.01); *B30B 9/301* (2013.01); *B30B 9/3042* (2013.01); *B30B 15/30* (2013.01);
(Continued)

(58) Field of Classification Search
CPC ... B30B 9/3042; B30B 9/3046; B30B 9/3007; B30B 9/3057; B30B 9/30; B65F 5/005;
(Continued)

(56) References Cited

U.S. PATENT DOCUMENTS 4,601,631 A * 7/1986 Van Raaij ..... E01H 1/0827 15/256.5
5,203,669 A * 4/1993 Klossek ..... B65F 3/201 100/100
(Continued)

FOREIGN PATENT DOCUMENTS

CN 20145621 U 5/2010
CN 102149620 A 8/2011
(Continued)

OTHER PUBLICATIONS

Chinese Search Report for Chinese Application No. 201480071459.9, dated Jun. 30, 2017.
(Continued)

*Primary Examiner* — Shelley M Self
*Assistant Examiner* — Jared O Brown
(74) *Attorney, Agent, or Firm* — Birch, Stewart, Kolasch & Birch, LLP

(57) ABSTRACT

Apparatus for handling material in connection with a pneumatic material conveying system, which apparatus comprises a waste container/separating device (50), into which material is adapted to be conducted from a conveying pipe (100) of the pneumatic material conveying system via an input aperture (55) and which is adapted to be connected to means for achieving a partial vacuum. The apparatus further comprises a press device/compactor device (70), which is arranged to act on the material (w) conducted into the waste container/separating device (50), via at least one aperture (69) formed in the container, and that at least one wall (60)
(Continued)

that is transverse with respect to the input direction of the material is arranged in the container space (68) of the waste container/separating device (50), and that at least one aperture (600) is arranged or formed in the wall (60), which aperture is fitted in the wall (60) on the path of travel (P) of the material (w) being fed in via the input aperture (55), which wall (60) is adapted to control or limit the movement of material in the container space (68). The invention also relates to a waste container/separating device.

19 Claims, 6 Drawing Sheets

(51) Int. Cl.

| | |
|---|---|
| ***B65F 1/10*** | (2006.01) |
| ***B65F 5/00*** | (2006.01) |
| ***B30B 15/30*** | (2006.01) |
| ***B65F 1/00*** | (2006.01) |

(52) U.S. Cl.
CPC ..... *B65F 1/0093* (2013.01); *B65F 1/105* (2013.01); *B65F 5/005* (2013.01); *B65F 2210/162* (2013.01)

(58) Field of Classification Search
CPC ..... B65F 1/105; B65F 1/1405; B65F 1/0093; B65F 2210/162; E01H 1/047; E01H 1/0827
See application file for complete search history.

(56) References Cited

U.S. PATENT DOCUMENTS

| | | | | |
|---|---|---|---|---|
| 5,226,757 | A | 7/1993 | Tarrant | |
| 6,138,557 | A * | 10/2000 | Brown | B30B 9/3007 100/191 |
| 7,607,195 | B2 * | 10/2009 | Tagliaferri | E01H 1/0863 15/340.1 |
| 8,881,341 | B2 * | 11/2014 | Schmidt, Jr. | B65F 1/105 15/340.1 |
| 2007/0157825 | A1 * | 7/2007 | Miller | B30B 9/301 100/240 |
| 2011/0155257 | A1 * | 6/2011 | Sundholm | B65F 5/005 137/15.01 |
| 2013/0004249 | A1 | 1/2013 | Sundholm | |
| 2014/0328633 | A1 * | 11/2014 | Nierescher | B65G 53/14 406/19 |

FOREIGN PATENT DOCUMENTS

| | | | | |
|---|---|---|---|---|
| DE | 3510700 | A1 | 9/1986 | |
| DK | 200000764 | A | 11/2001 | |
| EP | 0903306 | A1 * | 3/1999 | B65F 3/20 |
| FI | 20085852 | A | 3/2010 | |
| FI | 123410 | B | 3/2013 | |
| FR | 2696364 | A1 | 4/1994 | |
| GB | 1028300 | A | 5/1966 | |
| GB | 2241524 | A | 9/1991 | |
| GB | 2321024 | A | 7/1998 | |
| RU | 2560602 | C2 | 8/2015 | |
| SU | 1558734 | A1 | 4/1990 | |
| WO | 2013/038057 | A1 | 3/2013 | |
| WO | 2014/037611 | A1 | 3/2014 | |

OTHER PUBLICATIONS

Supplementary European Search Report for European Application No. 14871425.6, dated Sep. 5, 2017 (Search completed Aug. 28, 2017).
International Search Report, issued in PCT/FI2014/050940, PCT/ISA/210, dated Mar. 31, 2015.
Written Opinion of the International Searching Authority, issued in PCT/FI2014/050940, PCT/ISA/237, dated Mar. 31, 2015.

* cited by examiner

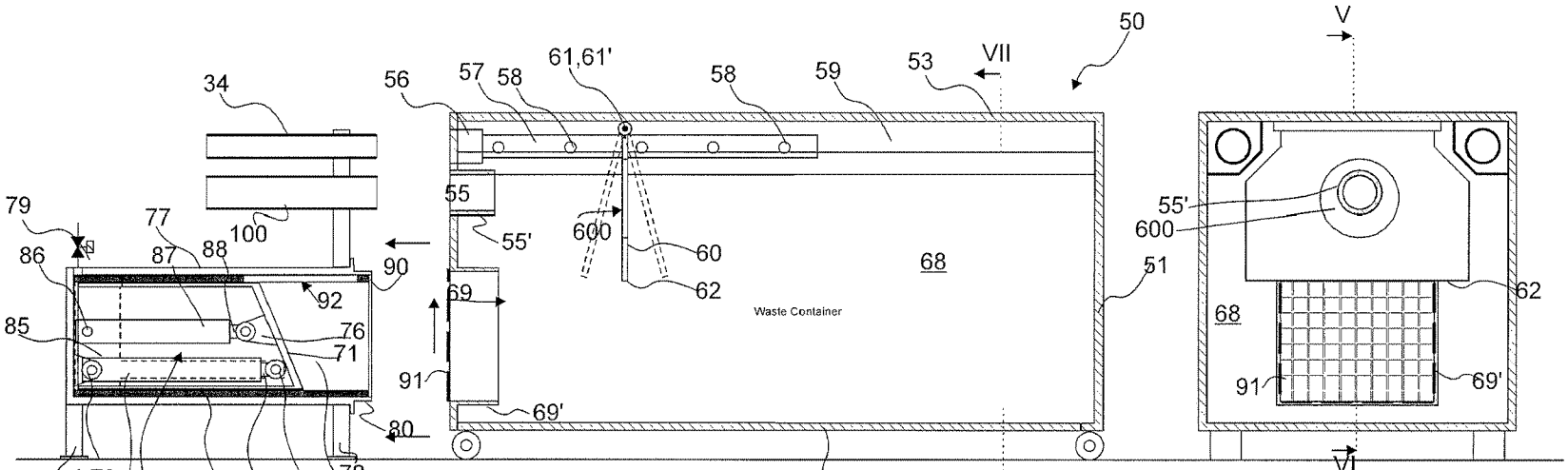
FIG. 6
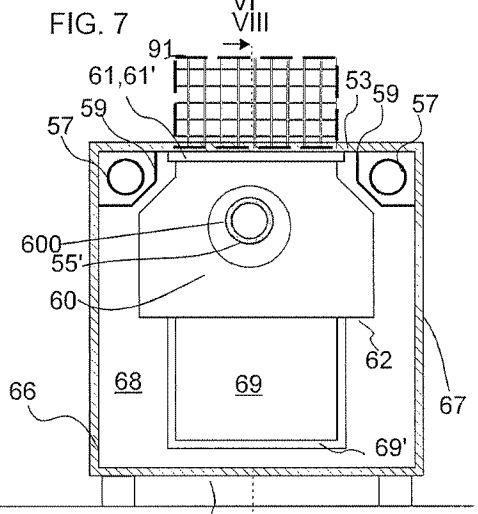
FIG. 7
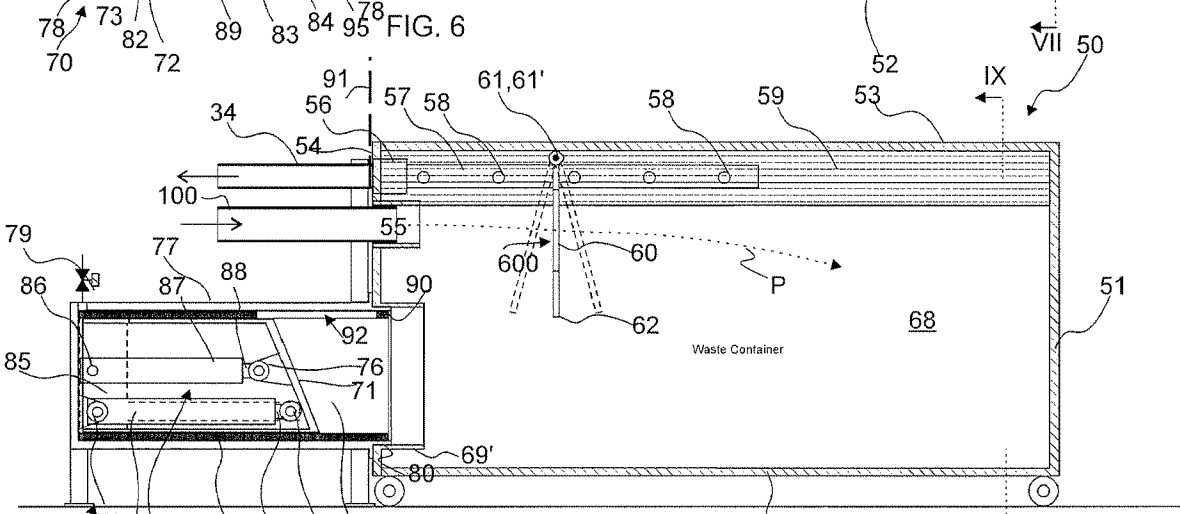
FIG. 8
FIG. 9

APPARATUS FOR HANDLING MATERIAL, AND WASTE CONTAINER/SEPARATING DEVICE

BACKGROUND OF THE INVENTION

The invention relates generally to material conveying systems, such as to partial-vacuum conveying systems, more particularly to the collection and conveying of wastes, such as to the conveying of household wastes.

Systems wherein wastes are moved in piping by means of a pressure difference or suction are known in the art. In these, wastes are conveyed long distances in the piping by sucking. It is typical to these systems that a partial-vacuum apparatus is used to bring about a pressure difference, in which apparatus a partial vacuum is brought about in the conveying pipe with partial-vacuum generators, such as with vacuum pumps or with an ejector apparatus. A conveying pipe typically comprises at least one valve means, by opening and closing which the replacement air coming into the conveying pipe is regulated. Input points, such as refuse chutes, are used in the systems at the material input end, into which input points material, such as waste material, is fed and from which the material to be conveyed is conveyed into a conveying pipe by opening a discharge valve means. The conveying of wastes occurs mainly by the aid of a pressure difference produced by an air flow. The air flow is generally brought about by sucking air through the piping. Waste material, such as e.g. waste material packed into bags, is conveyed from an input point into a conveying pipe and onwards into a separating device, where the wastes are separated from the transporting air. In connection with the separating device can be a transfer means, such as a transfer means arranged on a cylinder-piston combination, with which transfer means the wastes are displaced from the separating device into a waste container, e.g. into a freight container. These types of solutions comprising a separate separating device, e.g. a cyclone separator, and a waste container separate to it, are well suited to extensive systems in which the space requirements of the waste station do not set limitations. Also known in the art are solutions wherein waste material is conducted in a conveying pipe directly into a waste container, which simultaneously functions as a separating device. These are mainly intended for rather small systems. This type of waste container/separating device is often arranged to be a kind of freight container. In the art they are called horizontal separator containers. A problem in prior-art combinations of a waste container and separating device, more particularly in horizontal separator containers, is that in them a part of the material, or certain types of materials, remain in the container space loosely packed and thus take up space. On the other hand the waste material or recyclable material is in many embodiments packed into bags or sacks, which can in many cases break when it is conducted along with the transporting air into a waste container. This increases, inter alia, hygiene problems, as wastes are able to spread freely in the waste container.

The aim of the present invention is to achieve an entirely new type of solution in connection with a waste container/separating device of a pneumatic wastes conveying system. One aim of the invention is to achieve a waste container/separating device, by the aid of which the problems of prior art are avoided. Another aim is to achieve a combination of a waste container/separating device and a press device, by means of which material can be efficiently condensed into the container space of the waste container/separating device.

BRIEF DESCRIPTION OF THE INVENTION

The apparatus according to the present invention includes a waste container/separating device for a pneumatic pipe transporting systems for material with at least one input aperture formed in an end wall of the waste container/separating device. The at least one input aperture is connected from the pneumatic pipe transporting systems to a material conveying pipe. A connection is formed in the waste container/separating device for connecting with a counterpart, a pipe or hose coming from a suction side of a partial-vacuum generator, for bringing the suction/pressure difference needed in the conveying of material in the waste container/separating device, and via the input aperture in the material conveying pipe. A press device/compactor device is provided with an aperture that operatively connects the press device/compactor device to the waste container/separating device. At least one wall, that is transverse with respect to an input direction of the material, is arranged in a container space of the waste container/separating device. The at least one wall extends only to a part of the height of the container space wherein the at least one wall is arranged to be turnable or bendable at a top part around a transverse axis and at a distance from the at least one input aperture in a longitudinal direction of the container space and at a distance from the at least one input aperture in a direction of a path of travel of material to be fed in via the at least one input aperture. The at least one aperture is formed in the at least one wall from a first side to a second side of the at least one wall and the at least one aperture is fitted in the at least one wall on a path of travel of the material to be fed in via the at least one input aperture. The at least one wall controls or limits the movement of the material in the container space.

The solution according to the invention has a number of important advantages. One advantage, among others, achieved with the solution according to the invention is that a separate separating device is not needed, but instead the waste container functions as an effective separator device and at the same time material can be efficiently compacted in it. In the solution of the invention, therefore, material can be conducted directly into, and material can be compacted in, the waste container, which is preferably formed to be a container of the mobile freight container type. By arranging a wall in the container space of the waste container/separating device, in which wall is an aperture, the feeding of material into the container space through the aperture of the wall is enabled at least in the starting phase of filling the container. When the container space has filled to the wall up to the height of the aperture, it prevents the return or displacement of material being fed in and/or being compacted in the container space. When the material being fed in no longer passes through the aperture, the material being fed in is guided into the operating area of the press. When the waste material conducted through the aperture collides in the container space with the material already fed in there, its speed effectively stops, but more softly than if it had collided with a hard wall. In this case the material being fed into the container at a fairly high speed (e.g. in the region of 80 km/h) stays intact better. In addition, the solution affects a possible noise problem by producing a noise that is lower in volume and softer. When the wall and the infeed via the aperture into the container space "behind" the wall are combined, an effective solution is achieved for compressing material and compacting it, i.e. condensing it, in the container space. When the container space behind the wall fills, the compacting of the material with the press is started. In this case in the filling stage the compacting occurring by means of the press can be started only according to need, and the press does not need to be used in the starting phase of the filling of the container. This, inter alia, saves energy. The wall also prevents the return or displacement of compressed material in the container space backwards past the press. The wall part is thus adapted to prevent the passage of compressed material in the opposite direction to the compression direction, in which case material can be condensed into the container space efficiently with the press. By using a movable part that has a support surface, the wall part can be supported when the press is used. In this case material can be efficiently compacted into the container part better than before. The movable part can be a part of the press device, e.g. a moving frame of the press. The press device can have different embodiments, in which case the effective compression distance and other properties of it can be adapted according to the application site. The movable part can have an aperture on the side from which material is conducted via the input aperture into the container, in which case it can be used for the effective conducting of material into the operating range of the compression means. When the compression pressure of the press rises to a regulated value, the press part can be pulled out of the container space of the waste container/separating device, in which case material can be fed in and can fill the volume of the container space reserved by the press. In this case abundant material can be made to fit and be compacted in the container space. The solution according to the invention enables well e.g. waste material packed into bags or sacks or the storing of recyclable material in bags regardless of their high speed of arrival into the container space. This enables the effective sorting of material, packed into bags or sacks, fed into the container space e.g. in a sorting center to which the container is taken for emptying. The sorting can be performed e.g. by means of an RFID identifier arranged in the bags or in the closing means of the bags or on the basis of some other radio-frequency identifier or optical identifier. The waste container/separating device can be emptied easily, because the wall in the container space is arranged to be turnable away from the front, e.g. by hinging, in which case it does not hinder the emptying.

BRIEF DESCRIPTION OF THE FIGURES

In the following, the invention will be described in more detail by the aid of an embodiment with reference to the attached drawings, wherein FIG. 6 presents an embodiment of the apparatus according to the invention, cross-sectioned along the line VI-VI of FIG. 7, in a first position, FIG. 7 presents an embodiment of the apparatus according to the invention, cross-sectioned along the line VII-VII of FIG. 6, FIG. 8 presents a cross-section of an embodiment of the apparatus according to the invention, in a second position, cross-sectioned along the line VIII-VIII of FIG. 9, FIG. 9 presents an embodiment of the apparatus according to the invention, cross-sectioned along the line IX-IX of FIG. 8.

DETAILED DESCRIPTION OF THE INVENTION

Figure 1:
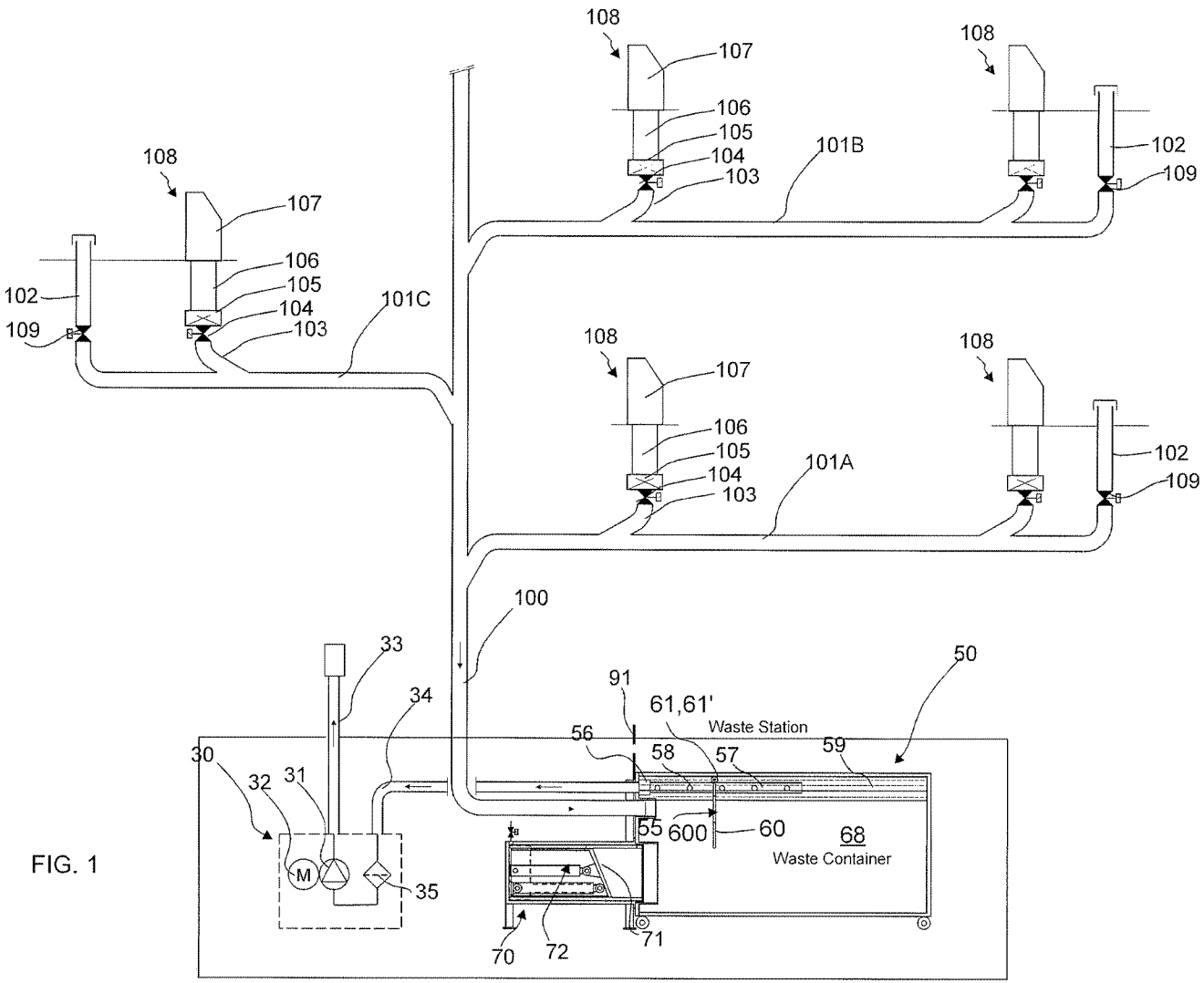
FIG. 1 presents a simplified and partially cross-sectioned view of an embodiment of the invention in connection with a pneumatic conveying system for wastes.

FIG. 1 presents a diagram of a part of a pneumatic material conveying system, which part comprises a material conveying pipe 100, along the side of which at least one, typically many, input points 108 are arranged. An input point 108 is a feed-in station of material, more particularly of waste material, intended for transporting, from which station the material, more particularly waste material, such as household waste, or recyclable material intended for transporting is fed into the conveying system. An input point 108 can also be a refuse chute, into which material is fed from input apertures on different floors of a building. The system can comprise a number of input points 108, from which the material intended for transporting is fed into conveying piping 100, 101A, 101B, 101C. By opening and closing a shut-off means, such as a valve means 104, that is possibly in connection with the feed-in station, material can be conveyed from an input point 108 into the conveying pipe 100. The input point 108 is connected on the valve side to the conveying pipe 100 or to an inlet pipe 103 in connection with it. Typically conveying piping comprises a main conveying pipe 100, to which it has been possible to connect a number of branch conveying pipes 101A, 101B, and in turn to which branch conveying pipes it has been possible to connect a number of feed-in stations 108. In the embodiment of FIG. 1 the input point 108 is an input point 107 of waste material, said input point 107 being disposed on the surface of the ground. The input point 108 is connected via a feed-in channel 106 to a material shaper 105, which shapes and condenses the material to fit into conveying piping 103, 101A, 101B, 101C, 100 smaller in diameter than the feed-in channel. The solution according to the invention is also suited to those types of material conveying systems in which material shapers are not used, but instead the material is conveyed from input points directly into the conveying piping. The conveying piping can be arranged to travel underground. In the embodiment of the figure the conveying piping comprises replacement air ducts 102, in which a replacement air valve 109 is arranged.

Figure 2:
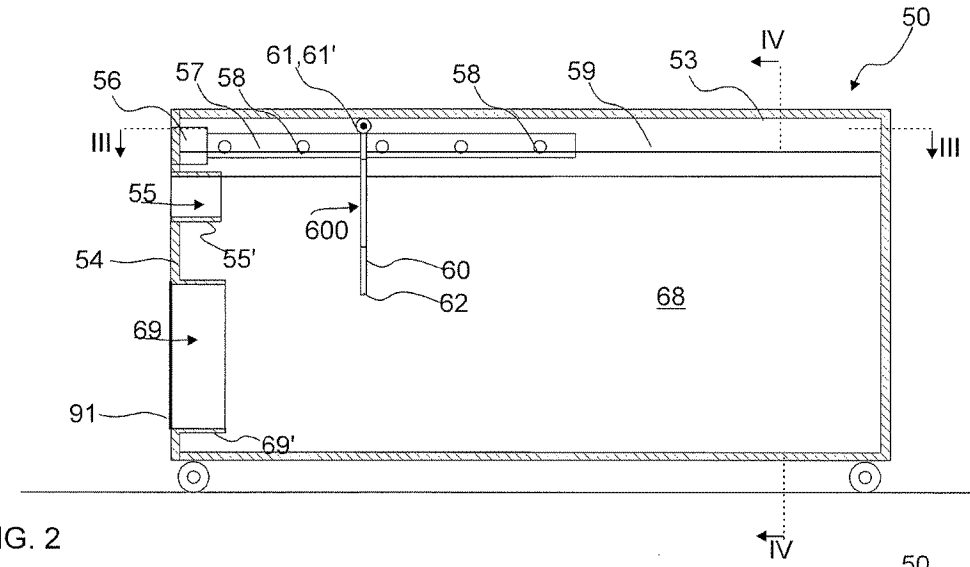
FIG. 2 presents an embodiment of the waste container/separating device according to the invention, cross-sectioned along the line II-II of FIG. 4.

An essential device in the invention is the waste container/separating device 50, which is according to the invention a combination of a material collection container, which is formed from a container, and of means arranged in it separating the transporting air and the material being conveyed from each other. According to one embodiment the waste container/separating device 50 is a movable container/separating device, for example a so-called horizontal separator container. The conveying pipe 100 can be connected to the waste container/separating device 50, in which the material being transported is separated from the transporting air. An input aperture 55, into which a conveying pipe 100 can be fitted, is formed in the wall of the waste container/separating device 50, which wall is an end wall 54 in the figure and which in the embodiment of the figure is also an openable and closable door. In FIG. 2 the end of the conveying pipe 100 is fitted into the input aperture 55, inside the wall 55' of it. A joint means can also be formed in the conveying pipe 100 and a counterpart in the wall of the container, in the input aperture 55, such as a collar formed from the wall 55'. The joint means and the counterpart can in this case together form a joint means, e.g. a snap-on coupling. A connection 56 is formed in the waste container/separating device 50, to which connection a pipe or hose 34 coming from a partial-vacuum generator 31, from the suction side of it, of a partial-vacuum source can be connected with a counterpart.

In the embodiment of FIG. 1 the partial-vacuum source 30 of the pneumatic waste conveying system comprises a partial-vacuum generator 31, which is driven with a drive device 32. The partial-vacuum generator 31 can be e.g. a vacuum pump, fan or some other means bringing about negative pressure. The suction side of the partial-vacuum generator 31 is connected to a waste container/separating device 50 via a medium pathway 34. In this case the suction/pressure difference needed in the conveying of material can be brought about in the waste container/separating device 50, in its container part 68, and via the input aperture 55 in the conveying piping 100, 101A, 101B, 101C. Between the partial-vacuum generator 31 and the waste container/separating device 50 is a filtering device 35. On the blowing side of the partial-vacuum generator 31 is an exhaust duct 33. The partial-vacuum source 30, the partial-vacuum generator 31 of it, can be connected from the suction side via the medium pathway 34 to the waste container/separating device 50 with a counterpart arranged in the connection 56.

Figure 4:
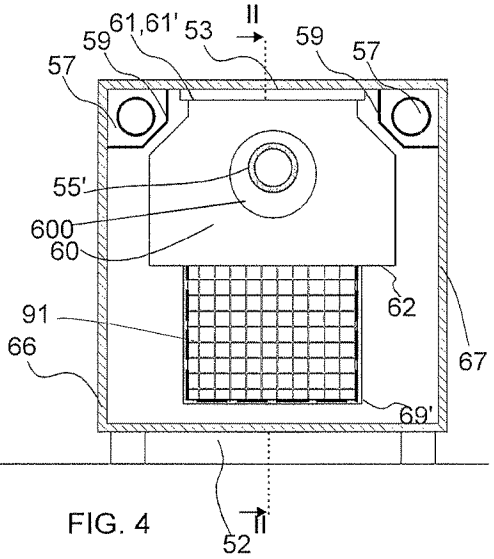
FIG. 4 presents an embodiment of the waste container/separating device according to the invention, cross-sectioned along the line IV-IV of FIG. 2.
Figure 3:
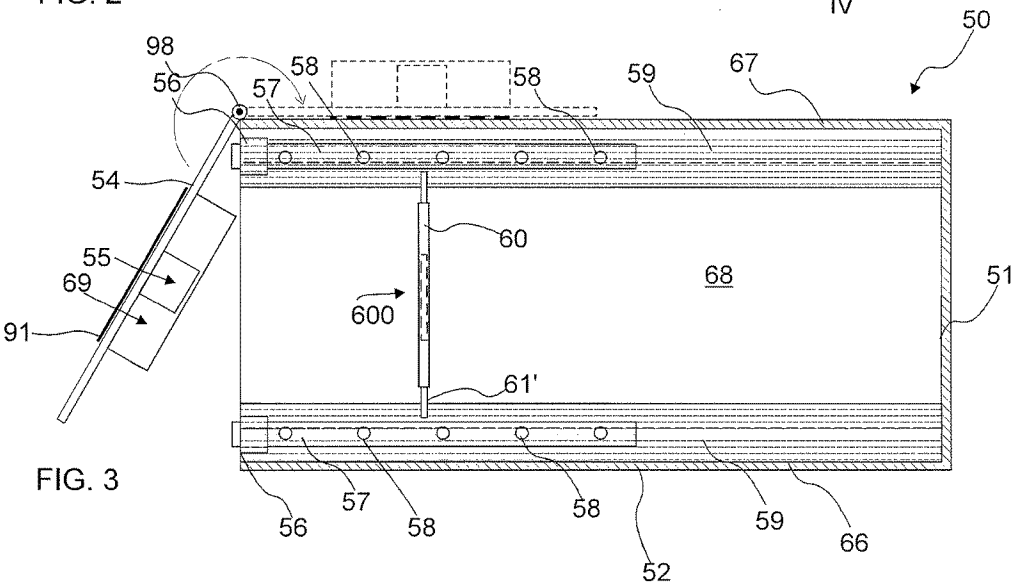
FIG. 3 presents an embodiment of the waste container/separating device according to the invention, cross-sectioned along the line III-III of FIG. 2.
Figure 10:
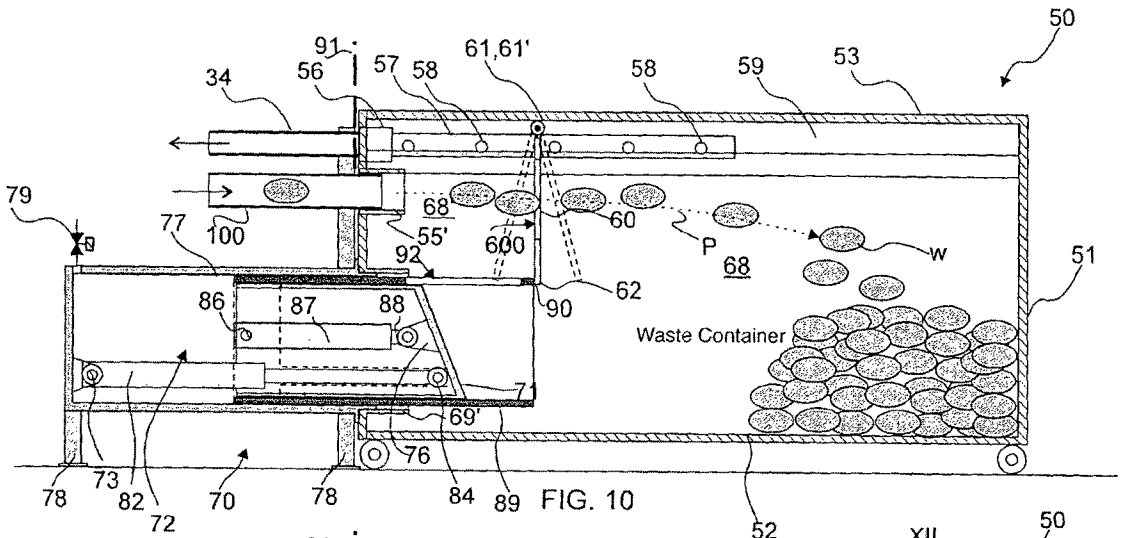
FIG. 10 presents a cross-section of an embodiment of the apparatus according to the invention, in a first operating phase.

The waste container/separating device 50 according to an embodiment of the invention is presented in more detail in FIGS. 2-4. In the solution according to FIGS. 2-4 the waste container/separating device 50 comprises a base 52, an end wall 51, a top wall 53, side walls 66, 67 and a second end wall, which in the embodiment of the figure is an openable and closable door 54. The walls 51, 52, 53, 54, 66, 67 bound the container space 68. A wall 60 is arranged in the container space 68, which wall extends from the top part of the container a distance towards the bottom part of the container when the wall 60 is in a vertical position. In the embodiment of FIGS. 2-4 the wall 60 is arranged to be hinged at its top part 61 around the axis 61' to the top wall 53 of the container. The wall 60 is therefore turnable in relation to the transverse axis 61'. The wall 60 is arranged to a part of the height of the container space 68, in which case a free space is between the bottom part 62 of the wall 60 and the base 52 of the container. The wall 60 is arranged at the point of the input aperture 55 in the height direction of the container, and at a distance from it in the longitudinal direction of the container. An aperture 600 is arranged in the wall 60, which aperture extends from the first side of the wall 60 to the other side of the wall, i.e. through the wall. The aperture 600 is arranged in the wall 60 at a point to which the material w being fed into the waste container/separating device via the input aperture 55 is carried. In FIGS. 8 and 10 one path of travel P of material in the container space 68 is presented with a dashed line. In this case the material w being fed in is thrown when fed in from the input aperture 55 through the aperture 600 of the wall 60 into the part of the container space 68 situated after the wall 60 in the travel direction. It is possible to bring about the throwing of the material through the aperture 600 up until, as the container space 68 fills, the material w that has been fed into the container space 68 and accumulated in it extends to the point of the aperture 600. In the embodiments of FIGS. 4, 7, 9 the aperture 600 is round, but it can also be of another shape. For example, in FIG. 13 the width of the aperture is greater than its height. Of course, the height can be greater than the width, depending on the application site. It can also be conceived that the wall 60 is formed from a number of wall parts side-by-side or one above another, between which at least one aperture 600 is formed or arranged. In FIG. 4, a gap remains between the side edges of the wall 60 and the side walls 66, 67 of the waste container/separating device. According to one preferred embodiment the wall is a flap that is hinged at its top edge. The wall 60 in FIGS. 2-4 is planar, but it can also be another shape, e.g. concave, convex or corrugated. The wall can be e.g. of metal such as steel, or of a plastic material, rubber material or combinations of these. Other suitable materials can be considered, depending on the application site.

In the embodiment of the figure, the waste container/separating device 50 has at least one suction pipe 57, which extends from the connection 56 into the inside space of the waste container/separating device. In the embodiment of FIGS. 2-4 a suction pipe 57 is arranged in the top part of the container space 68 of the waste container/separating device in the orthogonal cross-section (FIG. 4) of the container with respect to the longitudinal direction in the corner area, or in the proximity of same, between the top wall 53 and the side wall 66 and/or 67. In the embodiment of FIGS. 2-4 the waste container comprises two suction pipes 57. Of these, the first is arranged in the orthogonal cross-section (FIG. 4) of the container, with respect to the longitudinal direction of the container, in the corner area, or in the proximity of same, between the top wall 53 and the side wall 66 and the second suction pipe is arranged in the corner area, or in the proximity of same, between the top wall and the second side wall 67. A connection to the suction side of the partial-vacuum generator, i.e. suction, can be arranged via either one of the suction pipes or via both suction pipes. By varying the suction, e.g. the strength of the suction, between different suction pipes 57 the placement of material evenly in the container space 68 can be made more efficient. In this case by altering the point at which the suction acts or the strength of its action in the container space of the material container, the input direction and path of travel in the container space of material being conducted from the input aperture 55 into the container space 68 can be influenced.

At least one suction aperture 58 is arranged in the suction pipe 57 for the length of it. In the embodiment of FIGS. 2-4 there are a number of suction apertures 58 for the length of the suction pipe 57 and possibly also arranged on the rim of the wall of the suction pipe 57. A wall part 59, such as dense netting, that allows air to pass through is also arranged in the container space 68, which wall part allows air through but prevents the passage of at least large-sized waste material particles into the suction pipe 57 from the suction apertures 58. The wall part 59 that allows air to pass through and the top wall 66 of the container and one of the two side walls 66 or 67 form the longitudinal chamber space of the container, into which chamber space the suction pipe 57 is arranged. When the suction side of the partial-vacuum generator 31 is connected to act via the medium channel 34 and the connection 56 in the suction pipe 57, the suction acts via the suction apertures 58, and through the wall 59 that allows air to pass, into the container space 68 of the waste container/separating device and onwards via the input aperture 55 into the conveying piping 100, 101A, 101B, 101C.

An aperture 69 is arranged in the waste container/separating device 50 for bringing at least the press part 71 of the press device 70 into the container space 68. In FIGS. 2-4, the aperture 69 has a collar 69', which extends into the container space. In the embodiment of FIGS. 2-4 the aperture 69 for the press device is arranged in the same wall 54 as that in which the input aperture 55 is arranged, and below the input aperture 55 in the height direction.

According to one embodiment a hatch 91 is arranged to cover the aperture 69, which hatch is displaced from in front of the aperture 69 when the press device 70 is connected into connection with the waste container/separating device 50. In the embodiment of FIGS. 2-4, the door of the wall 54 is hinged to turn around a vertical axis 98, which is illustrated in FIG. 3. The door 54 can be turned in the open position against the outer side of the side wall 67 of the waste container/separating device, as is illustrated in FIG. 3 with dashed lines. This is a preferred position for the door when the container is emptied.

Figure 5:
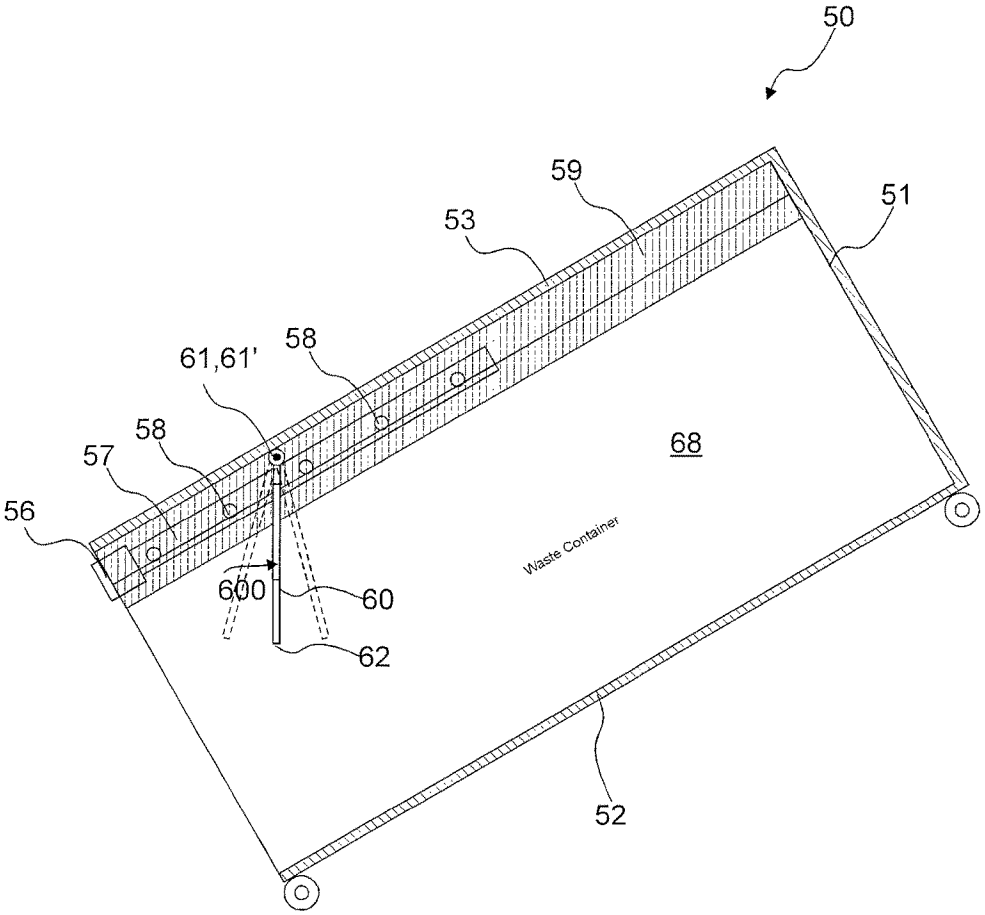
FIG. 5 presents an embodiment of the waste container/separating device according to the invention, in the emptying position

FIG. 5 presents a situation in which the waste container/separating device 50 is in the typical emptying position. It can be seen from the figure that the wall 60 in the container space 68 turns, preferably around the axis 61' owing to the hinging of its top edge 61, when emptying the container of material from the front, in which case emptying can be performed quickly and efficiently. Friction-reducing means, e.g. roller means according to the figure, which facilitate the moving of the waste container/separating device, can be arranged on the bottom part of the waste container/separating device 50.

FIGS. 6-9 present an embodiment of the device according to the invention, wherein a press device/compactor device 70, comprising a compression means 71 and its drive device 72, is arranged in connection with the waste container/separating device 50. The compression means 71 in the press device/compactor device 70 in the embodiment of the figure is arranged to be movable between at least two positions. The compression means 71 is arranged to displace and condense the waste material in the container part 68. The compression means displaces and simultaneously also compresses the material w to be denser, i.e. it compacts the waste into the container space 68. In the embodiment of FIGS. 6-9 the press device/compactor device 70 comprises a frame 77, in which the compression means 71 and its moving apparatus are arranged in a first position, i.e. the standby position. The frame 77 comprises a joint part 80, which is adapted in such a way that the counterpart, typically a collar 69', of the aperture 69 of the waste container/separating device 50 forms a joint with the joint part 80. In the embodiment of FIGS. 6-9 the collar 69' is arranged around the joint part 80 of the frame 77 of the press device/compactor device 70. The frame 77 is arranged in the embodiment of the figure on a machine bed resting on support legs 78. A pathway for medium is arranged in the frame 77 from the space in which the compression means is moved to the outside and to a valve means 79 there, which is a so-called blow valve.

FIGS. 6-14 present one embodiment of the invention. Likewise, FIGS. 6-9 present the bringing of a waste container/separating device 50 and connection of it into connection with a press device/compactor device 70 as well as with a conveying pipe 100 and with a channel 34 of a partial-vacuum generator. In FIG. 6 the waste container/separating device 50 is moved towards the press/compactor. The joint part 80 of the press/compactor device 70 and the end of the conveying pipe 100 as well as the end of the suction channel 34 are arranged, for example, in a supported manner in such a way that the necessary joints form, or are formed, when the waste container/separating device 50, the counterparts on it, the press aperture 69, input aperture 55 and connection 56 are brought against the joint part 80 and the end of the conveying pipe 100 and the end of the suction channel 34. According to one embodiment the hatch 91 is arranged to cover the aperture 69, which hatch is displaced from the position of FIGS. 6 and 7 upwards into the position of FIGS. 8 and 9, away from the front of the aperture 69, when the press device 70 is connected into connection with the waste container/separating device 50.

In the embodiment of FIGS. 6-9 a movable part 89 functioning as a moving frame of the press is arranged into connection with the press device/compactor device 70, which movable part when extended settles in the proximity of the bottom part 62 of the wall 60 arranged in the container space 68 of the waste container/separating device 50 and if necessary supports the wall 60 preventing its essential movement, such as a rotary movement around the axis 61', towards the wall 54 on the side of the input aperture 55. The movable part 89 has a support surface 90, against which the bottom part 62 of the wall 60 can rest. The movable part 89 has an aperture 92, which opens in the container space on the side of the input aperture 55 when the movable part 89 is taken into the second position (FIG. 10). From the aperture 92 material can pass to in front of the compression means 71 when the compression means is in the position according to FIGS. 10 and 13. The actual compressing movement of the compression means 71 and compacting of material w is performed according to FIG. 13, from the position of FIG. 13 into the position of FIG. 11.

Figure 13:
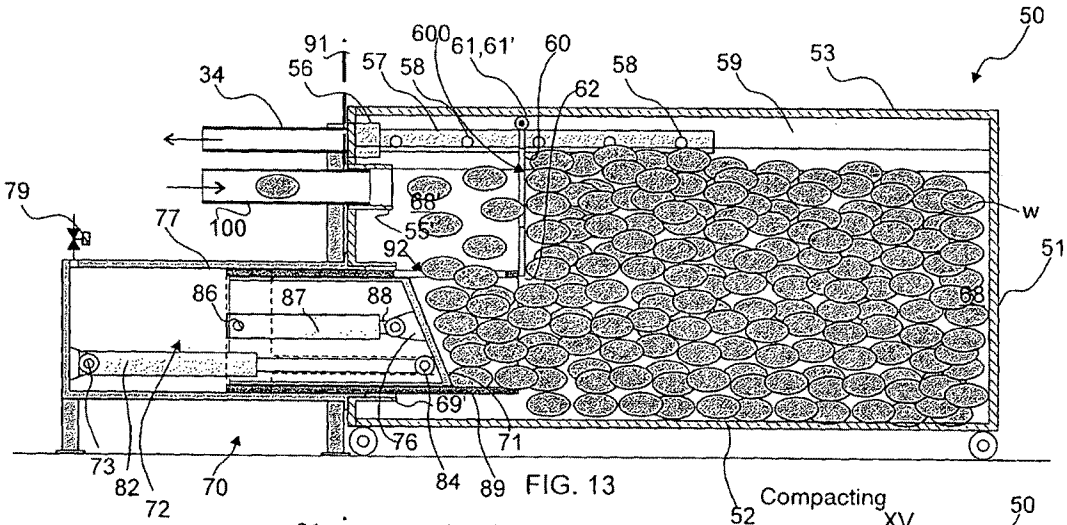
FIG. 13 presents an embodiment of an apparatus according to the invention.

In the embodiment of FIGS. 6-14 the drive apparatus 72 of the press device/compactor device 70 comprises a two-phase arrangement, in which a first drive device 82, 83 is arranged to move the movable part 89, which is now the moving frame of the press, as well as a second drive device 87, 88 and the compression means 71 connected to it into a second position (FIG. 10 and FIG. 13).

Figure 11:
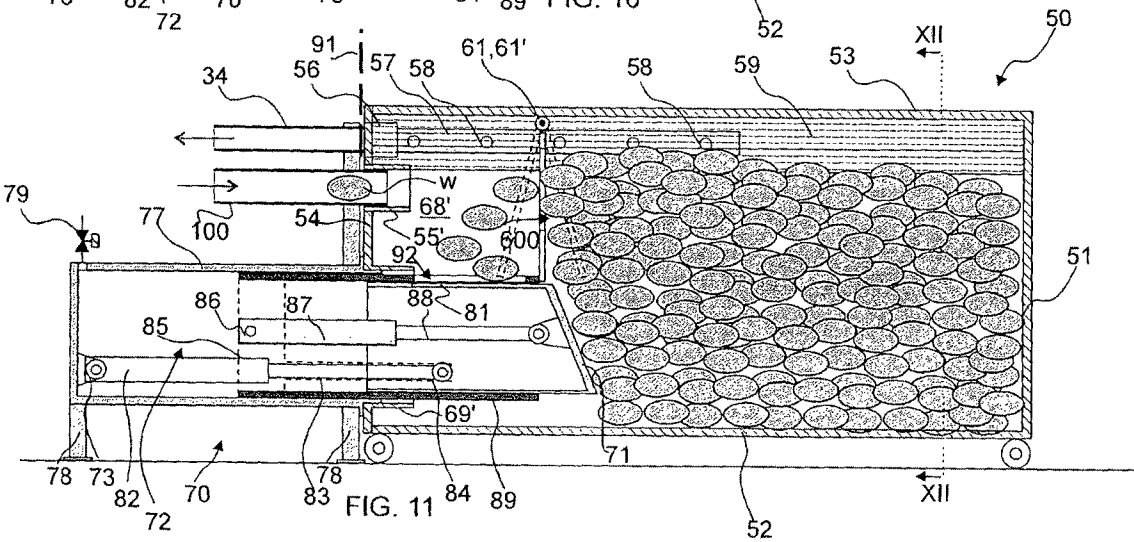
FIG. 11 presents an embodiment of the apparatus according to the invention in a second operating phase, sectioned along the line XI-XI of FIG. 12.
Figure 12:
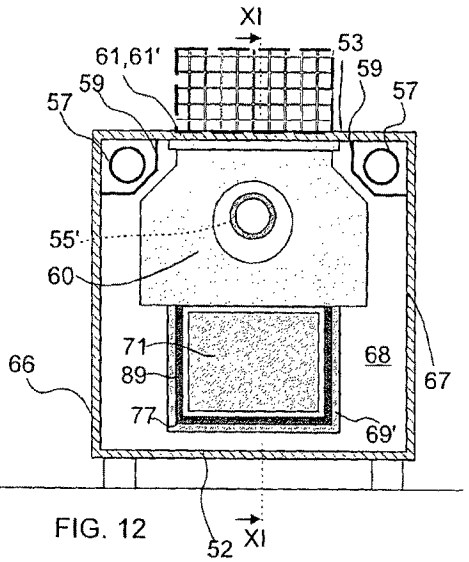
FIG. 12 presents an embodiment of the apparatus according to the invention in a second operating phase, sectioned along the line XII-XII of FIG. 11.

From the second position the compression means 71 is moved with the second drive device 87, 88 into a third position, which is presented in FIG. 11.

The first drive device 82, 83 is arranged at its first end 73, in the figure on the side of the cylinder 82, on the structures of the frame 77. At its second end 84, in the figure on the side of the rod 83 of the piston, the first drive device 82, 83 is arranged on a coupling part 85, on which the movable part 89 is arranged or which is a part of the movable part 89. The first end 86, in the figure the cylinder part 87, of the second drive device 87, 88 is in turn connected to the coupling part 85. The second end 76, in the figure on the side of the rod 88 of the piston, of the second drive device 87, 88 is connected to the compression means 71.

In the embodiment of FIGS. 6-14 the material can be efficiently guided via the aperture 92 of the movable part 89 to in front of the compression means for displacing and compressing into the container space, when the material is no longer able to go into the actual container space via the aperture 600 of the wall 60. In addition, a long compression stroke and an effective compacting of the material w into the container space 68 are achieved. In addition, the support surface 90 of the movable part 89 effectively prevents the undesired movement of the wall 60 towards the input aperture 55, and thus also for its part enhances the compaction of wastes in the container space 68. The wall 81 of the compression means 71 prevents passage of the material via the aperture 92 when the compression means is in the position of FIG. 11, i.e. in the compression position. In the embodiment of the figure the movable part 89 is tubular and can also function as a part of the bottom wall for the separating space 68' when the movable part 89 is in the second position, i.e. extended into the container 68.

Material w, such as household waste, is fed in from an input point 108 into the piping 101A, 101B, 101C, 100, where it is conveyed by the aid of suction/a pressure difference and/or transporting air flowing in the piping into the waste container/separating device 50 from the input aperture 55. When the container space of the waste container/separating device is empty or there is only a small amount of material in the container space 68 of the waste container/separating device, the movement path P of the material typically follows the trajectory presented with a dashed line in FIGS. 8 and 10. In this case the material is thrown a distance from the input aperture 55 through the aperture 600 of the transverse wall 60 and collides with the material w that is already in the container space 68 or with the wall 51 of the container and drops into the container space 68.

The material is thus separated from the transporting air, e.g. by the aid of collision and gravity, in such a way that heavier material W travels to the bottom part of the container. A suction pipe 57 is arranged in the top part of the waste container/separating device 50, which pipe is connected to the suction side of the partial-vacuum generator 31. The transporting air leaves the container part 68 of the waste container/separating device into the suction pipe 57. The wall 59 allowing air to pass through prevents the passage of at least the larger material particles into the suction pipe. The smaller particles are filtered in the filtering device 35 (FIG. 1).

The material is conducted into the container space 68 according to FIGS. 10 and 11. When the rear part that is after the wall 60 of the container space 68 starts to be full, so that the material is no longer able to go into the actual container space through the aperture 600 of the wall 60 but instead drops, e.g. guided by the material w blocked by the wall 60 or aperture 600, via the aperture 92 to in front of the compression means 71 of the press, the compression means starts to be moved between the second position presented by FIG. 13 and the third position (compression position) presented by FIG. 11. In this case the material displaces farther in the container space 68, pushed by the compression means of the press. With the compression means the material is displaced farther in the container space 68 from below the wall 60. The compression means 71 is moved reciprocally with the drive apparatus 72 between the second position of FIG. 13 and the third position of FIG. 11. It is also possible that the compression means 71 is moved only a part of the distance between the aforementioned extreme positions. When sufficient material collects in the container space 68, the compression means 71 compresses it, e.g. against the end wall 51, to be denser. The wall 60 arranged in the container space for its part prevents the compressed material w from returning in the container space 68 in an undesired manner to the input aperture 55 side with respect to the wall 60 in the container space 68. This part of the container space 68 is marked in the figure with the marking 68'. It can be called the separating part of the container. This space is bounded above by the top wall 53 of the container and the wall 59 that allows air through, the end wall 54 (i.e. the door) and the wall 60 arranged in the space, and below by at least one wall of the press device/compactor device 70 when it is pushed into the container space at least partly. In the embodiment of FIG. 11 the wall bounding the space 68' of the press device is the top wall 81 of the compression means.

Figure 14:
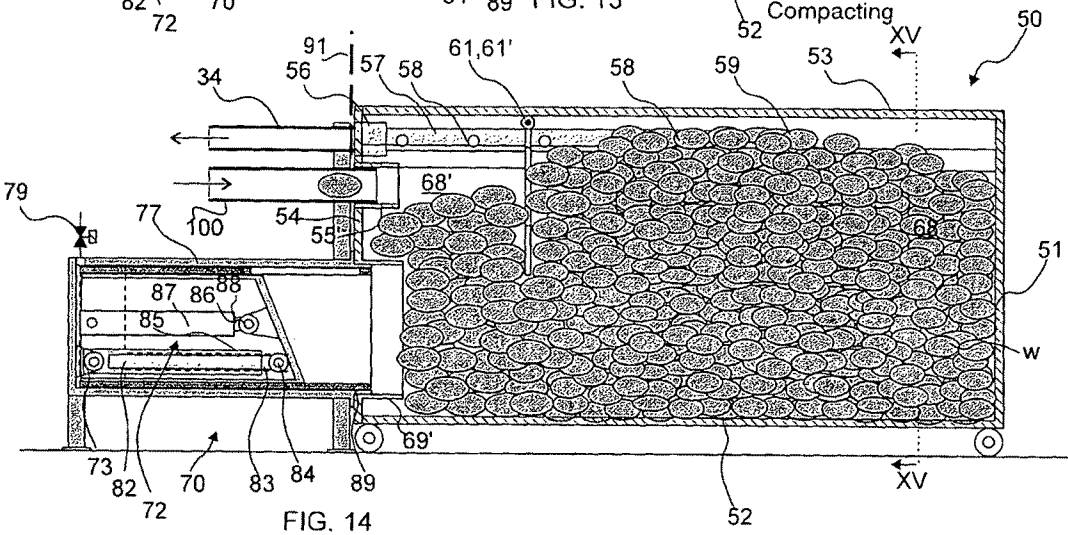
FIG. 14 presents an embodiment of an apparatus according to the invention in a fourth operating phase.
Figure 15:
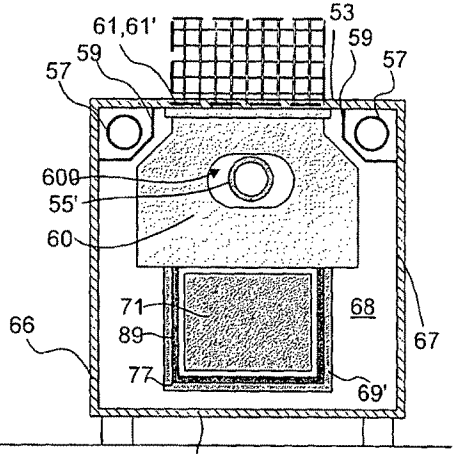
FIG. 15 presents an embodiment of an apparatus according to the invention, cross-sectioned along the line XV-XV of FIG. 14.

When the compression pressure rises up to a set limit the compacting is ended and the press is pulled into the position of FIG. 14 out of the container space, after which the container space reserved from the container space by the press, as well as the space 68' between the input aperture 55 of the container and the wall 60 can, still be filled. By means of the embodiments of the invention the container space of a waste container/separating device can be efficiently filled with an arrangement in which the press is only needed in the end phase of filling the container.

The filling can be made even more efficient by arranging the aperture 600 of the wall to be large in the width direction, e.g. according to the embodiment of FIG. 14, in such a way that the path of travel of material can be varied by varying the suction, e.g. the strength of the suction, between the different suction pipes 57. In this case the placement of material evenly in the container space 68 in the transverse direction of the container can be made more efficient. In this case by altering the point at which the suction of the partial-vacuum source acts or the strength of its action in the container space of the material container, the input direction and path of travel in the container space of material being conducted from the input aperture 55 into the container space 68 also via the aperture 600 can be influenced.

The invention thus relates to an apparatus for handling material in connection with a pneumatic material conveying system, which apparatus comprises a waste container/separating device 50, into which material is adapted to be conducted from a conveying pipe 100 of the pneumatic material conveying system via an input aperture 55 and which is adapted to be connected to means for achieving a partial vacuum. The apparatus further comprises a press device/compactor device 70, which is arranged to act on the material w conducted into the waste container/separating device 50, via at least one aperture 69 formed in the container, and that at least one wall 60 that is transverse with respect to the input direction of the material is arranged in the container space 68 of the waste container/separating device 50, and that at least one aperture 600 is arranged or formed in the wall 60, which aperture is fitted in the wall 60 on the path of travel P of the material w to be fed in via the input aperture 55, which wall 60 is adapted to control or limit the movement of material in the container space 68.

According to one embodiment the compression means 71 of the press device/compactor device is arranged to move in the container space with a drive apparatus 72 between a first position and a second position.

According to one embodiment the compression means 71 of the press device/compactor device 70 is adapted to move in the container space from the first position, in which the compression means 71 is not essentially in the container space 68, into a second position, in which the compression means extends to at least the point of the wall 60 in the container space 68.

According to one embodiment the apparatus comprises a movable part 89, which comprises a support surface 90, which is adapted in the support position to support the wall 60.

According to one embodiment the wall 60 is arranged to be turnable or bendable at its top part 61 around a transverse axis 61'.

According to one embodiment the wall 60 is adapted to receive the load exerted by the material w at least when it is supported with the support surface 90.

According to one embodiment an aperture 69 for the press device/compactor device 70 is formed in the wall 54 of the waste container/separating device 50 essentially in the proximity of the input aperture 55, most suitably below it.

According to one embodiment the press device/compactor device 70 comprises a movable part 89, which comprises a support surface 90 for the wall 60, which movable part is arranged to be moved with a drive apparatus 72.

According to one embodiment an aperture 92 is formed in the movable part 89, via which aperture the material is guided into the operating range of the compression means 71.

According to one embodiment the wall 60 is adapted to limit the passage of material w from the container space 68 in the opposite direction with respect to the compression direction.

The invention also relates to a waste container/separating device for pneumatic pipe transporting systems for material, which device comprises at least one input aperture for connecting it to a material conveying pipe, means for connecting a partial-vacuum generator to the container and means for connecting a press device/compactor device. At least one wall 60 that is transverse with respect to the input direction of the material is arranged in the container space 68 of the waste container/separating device, and that at least one aperture 600 is arranged or formed in the wall 60 from the first side to the second side of the wall, which aperture 600 is fitted in the wall on the path of travel P of the material to be fed in via the input aperture 55, which wall is adapted to control or limit the movement of material in the container space 68.

According to one embodiment the wall 60 extends to a part of the height of the container space 68.

According to one embodiment the wall 60 is arranged to be turnable or bendable at its top part 61 around a transverse axis 61'.

According to one embodiment the wall 60 is arranged at its top part 61 on the upper wall 53 of the waste container/separating device or in the proximity of said upper wall.

According to one embodiment the wall 60 is adapted to rest, preferably at its bottom part 62, on the support surface 90 of the press or on another support surface.

According to one embodiment the wall 60 is arranged to turn away from the front when the waste container/separating device 50 is emptied of material w.

According to one embodiment the wall 60 is adapted to receive the load exerted by the material w at least when it is supported with the support surface 90.

According to one embodiment the waste container/separating device 50 comprises a suction pipe 57 arranged in the top part of the container space 68.

According to one embodiment the aperture 69 of the press arranged in the waste container/separating device 50 and the input aperture 55 are in the proximity of each other, preferably in the same wall 54.

According to one embodiment the wall 60 is adapted to limit the passage of material w from the container space 68 in the opposite direction with respect to the compression direction.

According to one embodiment the wall 60 is formed from a number of wall parts.

According to one embodiment the aperture 600 is adapted to allow different paths of travel P of the material w. In this case the input direction of the material into the container space can be controlled e.g. by varying the suction or the strength of the suction between the different suction pipes.

According to one embodiment the waste container/separating device is container of the freight container type.

Typically the material is waste material, such as waste material arranged in bags. The refuse chute can be fitted to be a part of a pneumatic waste conveying system or it can be a separate part, in which waste material is conducted into the waste room, waste container or corresponding.

It is obvious to the person skilled in the art that the invention is not limited to the embodiments presented above, but that it can be varied within the scope of the claims presented below. The characteristic features possibly presented in the description in conjunction with other characteristic features can also, if necessary, be used separately to each other.

The invention claimed is:

1. A waste container/separating device for a pneumatic pipe transporting systems for material, which device comprises:

at least one input aperture formed in an end wall of the waste container/separating device, said at least one aperture connectable to the pneumatic pipe transporting systems, a connection formed in the waste container/separating device for connecting with a counterpart, a pipe or hose coming from a suction side of a partial-vacuum generator, for bringing the suction/pressure difference needed in the conveying of material in the waste container/separating device, and via the input aperture in the end wall of the waste container/separating device, and a press device/compactor device, an aperture for operatively connecting the press device/compactor device to the waste container/separating device, wherein at least one wall, that is transverse with respect to an input direction of the material, is arranged in a container space of the waste container/separating device, said at least one wall extends only to a part of the height of the container space wherein the at least one wall is arranged to be turnable or bendable at a top part around a transverse axis and at a distance from the at least one input aperture in a longitudinal direction of the container space and at a distance from the at least one input aperture in a direction of a path of travel of material to be fed in via the at least one input aperture, and wherein at least one aperture is formed in the at least one wall from a first side to a second side of the at least one wall, said at least one aperture is fitted in the at least one wall on a path of travel of the material to be fed in via the at least one input aperture, said at least one wall is adapted to control or limit the movement of material in the container space.

2. The waste container/separating device according to claim 1, wherein the at least one wall is arranged at a top part on an upper wall of the waste container/separating device.

3. The waste container/separating device according to claim 1, wherein the at least one wall is adapted to rest, at a bottom part, on a support surface.

4. The waste container/separating device according to claim 1, wherein the at least one wall is arranged to turn away from a front side when the waste container/separating device is emptied of material.

5. The waste container/separating device according to claim 1, wherein the at least one wall is adapted to receive a load exerted by the material.

6. The waste container/separating device according to claim 1, wherein the waste container/separating device includes a suction pipe arranged in a top part of the container space.

7. The waste container/separating device according to claim 1, wherein the aperture in the end wall of the waste container/separating device for accommodating the press device/compactor device and the at least one input aperture are arranged adjacent to each other.

8. The waste container/separating device according claim 1, wherein the at least one wall is formed from a plurality of wall parts.

9. The waste container/separating device according to claim 1, wherein a width or a height of the at least one aperture in the at least one wall is adapted to allow different paths of travel of the material from the at least one input aperture into the container space via the at least one aperture in the at least one wall.

10. The waste container/separating device according to claim 1, wherein the waste container/separating device is a freight container.

11. The waste container/separating device according to claim 1, wherein the press device/compactor device is arranged to act on the material conducted into the waste container/separating device via the at least one aperture formed in the end wall of the waste container/separating device.

12. The waste container/separating device according to claim 11, wherein a drive apparatus is operatively connected to the press device/compactor device to move the press device/compactor device in the container space between a first position and a second position.

13. The waste container/separating device according to claim 12, wherein the press device/compactor device is arranged to move in the container space from the first position, wherein the drive apparatus is not in the container space, and into a second position, wherein the drive apparatus extends to at least a point adjacent to the at least one wall in the container space.

14. The waste container/separating device according to claim 11, and further including a movable part having a support surface, said support surface is adapted to be selectively moved to a support position for supporting the at least one wall.

15. The waste container/separating device according to claim 14, wherein the at least one wall is adapted to receive a load exerted by the material when the at least one wall is supported with the support surface.

16. The waste container/separating device according to claim 11, wherein the at least one aperture for the press device/compactor device is formed in the end wall of the waste container/separating device below the at least one input aperture.

17. The waste container/separating device according to claim 11, wherein the press device/compactor device includes a movable part including a support surface for supporting the at least one wall, which movable part is arranged to be moved with a drive apparatus.

18. The waste container/separating device according to claim 17, wherein an aperture is formed in the movable part, via which aperture the material is guided into the operating range of the press device/compactor device.

19. The waste container/separating device according to claim 1, wherein the at least one wall is adapted to limit the passage of material (w) material from the container space in an opposite direction with respect to the compression direction.

* * * * *